United States Patent [19]

Hintermann et al.

[11] Patent Number: 4,556,098

[45] Date of Patent: Dec. 3, 1985

[54] HOT CHAMBER DIE CASTING OF ALUMINUM AND ITS ALLOYS

[75] Inventors: Hans E. Hintermann, Bern; Dominique Hertz, Neuchâtel, both of Switzerland

[73] Assignee: Laboratoire Suisse de Recherches Horlogeres, Switzerland

[21] Appl. No.: 124,257

[22] Filed: Feb. 25, 1980

Related U.S. Application Data

[63] Continuation of Ser. No. 935,011, Aug. 18, 1978, abandoned.

[51] Int. Cl.[4] ..... B22D 17/04

[52] U.S. Cl. ..... 164/316; 164/138

[58] Field of Search ..... 164/138, 75, 312, 316, 164/317, 318

[56] References Cited

U.S. PATENT DOCUMENTS

| | | | |
|---|---|---|---|
| 2,660,769 | 12/1953 | Bennett | 164/337 X |
| 2,874,065 | 2/1959 | Herz et al. | 427/423 |
| 3,319,702 | 5/1967 | Hortwig et al. | 164/316 |
| 4,091,970 | 5/1978 | Komiyama et al. | 164/316 X |

FOREIGN PATENT DOCUMENTS

| | | | |
|---|---|---|---|
| 1811004 | 10/1973 | Fed. Rep. of Germany . | |
| 2242837 | 4/1974 | Fed. Rep. of Germany . | |
| 74623/74 | 7/1974 | France . | |
| 51-17121 | 2/1976 | Japan | 164/138 |
| 359338 | 2/1962 | Switzerland . | |
| 492497 | 8/1970 | Switzerland . | |
| 578390 | 8/1976 | Switzerland . | |
| 588320 | 5/1977 | Switzerland . | |
| 580916 | 9/1946 | United Kingdom . | |
| 588780 | 6/1947 | United Kingdom . | |
| 745037 | 2/1956 | United Kingdom | 164/138 |
| 773009 | 4/1957 | United Kingdom . | |
| 967355 | 8/1964 | United Kingdom . | |
| 1280383 | 7/1972 | United Kingdom . | |
| 1365292 | 8/1974 | United Kingdom . | |

OTHER PUBLICATIONS

"Monometer Proof of Success", Foundry Trade Journal, May 31, 1973, pp. 700–703.

"Betriebliche Untersuchunger Zum Vergielsen von Aluminum mit Warmkammer-Druckgiessmaschinen" by Von P. William Marshall, Giesserei 58, 1971, No. IV.

"Aluminum", Aluminum-Verlag GmbH-Dusseldorf-Jagerhofstrasse 29, Sonderabdruck aus 39, Jahrgang (1963), pp. 1–10.

*Primary Examiner*—Kuang Y. Lin

*Attorney, Agent, or Firm*—Parkhurst & Oliff

[57] ABSTRACT

A hot chamber die casting apparatus for casting aluminum, zinc, magnesium, copper and their alloys as well as other metals which, in the molten state, corrode ferrous materials. The apparatus comprises a crucible, an injection pump in the crucible, and a gooseneck leading from the crucible to an outlet nozzle. The parts of the apparatus have coatings or sleeves of materials which resist corrosion, abrasion, erosion and mechanical or thermal shocks.

15 Claims, 2 Drawing Figures

HOT CHAMBER DIE CASTING OF ALUMINUM AND ITS ALLOYS

This is a continuation of application Ser. No. 935,011, filed Aug. 18, 1978, now abandoned.

BACKGROUND OF THE INVENTION

The present invention concerns a hot chamber die-casting apparatus which works under pressure and is used to cast articles of pure aluminum or its alloys as well as pure zinc, magnesium, copper and their alloys and all other alloys which strongly corrode ferrous materials. The apparatus permits the production of articles with an excellent surface finish without inclusions of oxides or anything else and without any contamination from the apparatus itself. In thin sections the articles produced are of uniform quality, improved ductility, and unweakened by iron dissolution.

In casting under pressure, two processes can be distinguished: cold chamber die casting and hot chamber die casting. The former is characterized by the fact that the molten metal is ladled into an unheated injection cylinder before each filling of the die. The second process is characterized by the fact that the injection cylinder is at the same temperature as the molten metal. The main disadvantages of the cold chamber process are:

- when the molten metal is transported from the holding furnace to the chamber, a certain amount of oxide is simultaneously transferred
- it is difficult to determine the exact quantity of molten metal ladled,
- there is a variation of the oxide content of the molten metal which influences the quality of the parts,
- further oxidation of the molten metal occurs during the filling of the injection cylinder,
- metal contamination by the lubricant of the injection cylinder occurs,
- there is no regular temperature evolution during casting.

The advantages of the hot chamber process are:

- more regularity in the metal temperature at the die entrance,
- the injection cylinder is filled without contact between the air and the metal being injected,
- a uniform composition of liquid results.

Concerning Production

- higher productivity results due to better utilization of the apparatus and a lower scrap rate regarding the casting and secondary operations.
- the need for hand-ladling or auto-ladling is eliminated,
- there is a greater potential for automation,
- reproducible, predictable and controllable casting cycle results.

Concerning Die Peformance

- there are multiple possibilities of positioning the die,
- less internal pressure results,
- there is less thermal variation as a result of faster and more uniform cycles,
- there is less shrinkage of the casted part in the die,
- the apparatus has longer life.

While there has been success in the hot chamber die casting of lead, tin and zinc alloys by way of a piston pump injection cylinder, the application of this technique has proved to be unsuccessful as far as aluminum and other corrosive metal alloys are concerned because ferrous material are quickly attacked by these metals when molten, thus limiting the life of the pump.

A gooseneck air machine has been used for aluminum alloys in order to obtain the advantages of the hot chamber process. However, the castings thus produced are not satisfactory in porosity and show increased iron content, the latter increasing the brittleness of the castings. At the present time, the casting of aluminum under pressure is essentially done with the cold chamber process, which is limited by the problems which arise from its unadaptability to automatization. The hot chamber process with the piston pump is a simple process which could make automatization possible (as in the case of zinc die casting) and thereby enable more economic production with better uniform quality.

Nevertheless, molten aluminum alloys are so corrosive that on the market at the moment, there is not a single properly adapted hot chamber die pump for casting these metals under pressure depite the encouraging results already obtained.

Indeed, Union Carbide Corporation has filed two patents (U.S. Pat. No. 3,319,702 and U.S. Pat. No. 3,586,095) concerning piston pumps, the elements of which (the piston and the cylinder), being very exposed to erosion and corrosion, are made of sintered $TiB_2$ and $ZrB_2$, and can withstand 50,000 cycles. Such pumps produce an increase of the iron content in the alloy which is less than 0.05% after 150,000 cycles (C. F. Fulgenzi, Trans Soc of Die Casting Eng 1968 paper 46). However, prolonged tests of these pumps on production machines (P. W. Marshall, Foundry Trade Journal, Nov. 26, 1970, 797) showed that their lifetime was irregular (from 600 to 57,000 cycles). The main reasons for the early degradation of the piston and cylinder are the poor resistance of $TiB_2$ and $TrB_2$ to thermal shock and the extremely large thermal expansion differences between cast iron and these materials which, in the long run, free-play and out of roundness of the parts. Again, the increase in the iron content of the alloy is very small (0.2%). This increase is nevertheless too large if alloys which contain very little iron are to be cast.

A Japanese patent (J P 74 074 523) describes an invention concerning a pump to be used only in aluminum casting which has been tested with molten aluminum. It can endure 120,000 cycles under a pressure of 150 kg/cm$^2$, with a piston and cylinder made of hot-pressed TiC (75%)+$Si_3N_4$ (25%) and 160,000 cycles under a pressure of 120 kg/cm$^2$ with a piston and cylinder made of hot-pressed TiC (52%), $Si_3N_4$ (25%), $TiB_2$ (20%), and $CrB_2$ (3%).

A German patent (2 320 887) discloses the use of pump parts made of AlN alloyed with 0.1 to 10% in weight of $Y_2O_3$, $La_2O_3$, $Sc_2O_3$, $Ce_2O_3$, $Al_2O_3$ or metallic silicates. Pistons and cylinders made of these hot pressed substances have a lifetime of 100,000 to 130,000 pumping cycles of molten aluminum alloy.

A Japanses patent registered in Switzerland under the number CH 586 581 describes an injection pump characterized by a piston and cylinder or a coating of the latter which are manufactured from a sintered body consisting of a mixture of carbides and borides such as boron carbide 10 to 90% in weight, preferably 30–70%, titanium boride 5–60%, zirconium boride 5–60%, boron nitride 0.5–30%, and possibly 0 to 5% tantalum, molybdenum, tungsten borides, zirconium, silicon, tantalum, vanadium, chromium, tungsten, molybdenum carbides, aluminum, silicon, titanium, zirconium nitrides, aluminum and beryllium oxides.

The porosity of the sintered body is lower than 5%, its resistance to flexion above 400 kg/cm$^2$ and its hardness above 1400 kg/mm$^2$.

Tests with piston and cylinders made of such materials have been carried out. In certain cases, the main chamber body of cast iron, covered with graphite to protect it, becomes corroded by the fused metal (Al, 1.5–3.5 Cu, 10.5–12 Si, 0.3 Mg, 1 Zn, 0.9 Fe, . . . ) after 110,000 to 160,000 injection cycles under a pressure of 150–250 kg/cm$^2$, although no sign of corrosion on the cylinder or the piston has been detected. However, it seems that this pump can only be used to cast zinc and magnesium alloys.

Thus it seems that there are certain materials adapted to the construction of the piston and cylinder even though they are not entirely satisfactory. However, the life of the pump and the quality of the cast pieces remain limited due to the corrosion and wearing out of the parts of the pump other than the piston and cylinder. The problems that must be solved in order to realize a pumping apparatus on a piston pump correspond to the four parts of this pump and may be stated as follows:

- piston and cylinder corrosion, abrasion, and mechanical constraints such as loosening, poor fitting, alignment and others.
- cylinder-end and gooseneck corrosion and erosion,
- nozzle corrosion, erosion, oxidation in air, mechanical and thermal shocks,
- crucible corrosion and oxidation in air.

The materials to be used to realize such a pump must be resistant to corrosion by molten aluminum, to abrasion and erosion, be quite hard and process expansion coefficients similar to those of ferrous materials. Also, for certain uses already stated, they must be able to resist oxidation and thermal and mechanical shocks. Finally, it is desirable to be able to use materials which are not wetted by molten metal and which are as dense as possible.

Table I shows several known properties of the materials which are the most resistant to molten aluminum corrosion, but other properties must also be taken into account as far as the realization of a pump is concerned.

SUMMARY OF THE INVENTION

The object of the present invention is to produce a pump allowing casting under pressure by the hot chamber process of articles made of aluminum alloys and other metals and alloys which are corrosive toward ferrous materials. It is a further object of the present invention to produce such a pump which has a long life—more than 150,000 cycles and which is reliable and does not result in any increase in the brittleness of the cast articles due to the iron content of the cast alloys.

TABLE I

| Material | Liquid Al Wetting Angle | Hardness | Thermal Expanison Coef. 0–750° C. $10^{-6}$ $C^{-1}$ | Resistance to Oxidation | Resistance to Thermal Shock |
|---|---|---|---|---|---|
| Cast Iron (Cr) | | 250–700 HB | 9–10 | average | |
| Cast Iron | | 180–350 HB | 15,5 | average | |
| Metal (Cr) | | average | 9,5 | good | good |
| Graphite* | small | low | | poor | excellent |
| $Si_3N_4$ | 157° (700° C.) | 2500–3000 | 2,45–3,2 | excellent | excellent |
| AlN | 138° (900° C.) | 1250 HV | 5,6 | excellent | excellent |
| BN | 170° (1000° C.) | low | 12–13 | | average |
| Si—Al—N—O | small | high | | good | |
| $Al_2O_3$ | average | 2000 HV | 8,1–8,3 | excellent | poor |
| BeO | average | 2000 HV | 10 | excellent | excellent |
| Al titanate | small | average | 0–1,5 | excellent | excellent |
| Stumatite | small | low | 7–8,5 | excellent | good |
| $TiB_2$ | 160° (700° C.) 140° (900° C.) | 3400 HV | 4,6–6,3 | good | poor |
| $ZrB_2$ | 160° (700° C.) 106° (900° C.) | 2000 HV | 4,5–7 | good | poor |
| $CrB_2$ | small | 1800 HV | 5,4 | good | poor |
| TiC | 148° (900° C.) | 3000 HV | 7–8,5 | average | poor |
| TiN | 135° (900° C.) | 2000 HV | 9,3 | average | poor |
| SiC | | 3000 HV | 4,7–5,5 | excellent | good |

*Remark: attacked by Al—Si

The present invention is characterized by the nature of the materials used to protect the piston and cylinder from corrosion and wear i.e. $Si_3N_4$ and Sialones, as well as by the protection of the whole or part of the other parts in contact with the molten metal and by the way the different parts are assembled.

DESCRIPTION OF THE PREFERRED EMBODIMENTS

Figure 1:
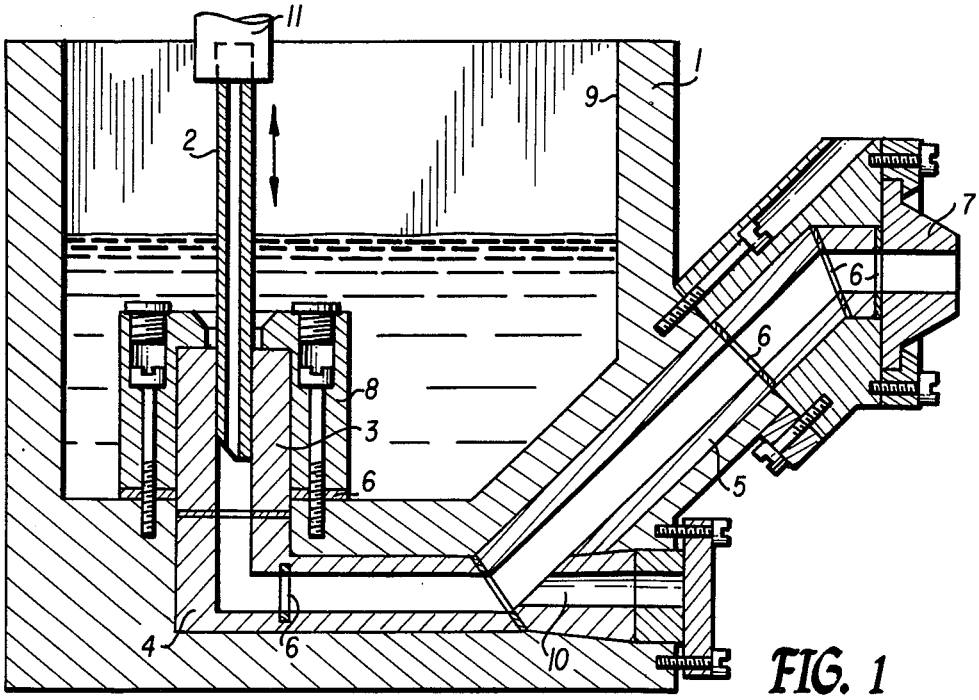
FIG. 1 is a detailed cross-section illustrating the claimed invention.

The apparatus is composed of a crucible for the molten metal, an injection pump, a die and means for the heating and entrainment of the pump's piston. The pump, as shown in FIG. 1 in one form, is made of a crucible 1, a piston 2 and a cylinder 3, a cylinder-end 4, a gooseneck 5 and an outlet nozzle 7. The pump.is made so that the various elements are protected from corrosion and/or oxidation and/or abrasion and/or erosion and/or thermal and mechanical shocks by materials resistant to those different stresses which are present as entire parts or as sleeves of parts.

Other than by its construction materials, the pump is characterized by the fact that the cylinder 3 is fixed to the bottom of the vessel by a cylinder support 8 so that only the piston 2 rises from the bath. This arrangement prevents the part of the piston which is above the molten metal from becoming soiled too quickly by the oxide formed at the surface of the bath, an oxide which would tend to wear out and block the piston-cylinder system.

The reciprocating motion of the piston is guided in two places, at the top with the aid of a piston holder 11 and at the bottom by the cylinder, from which it never exits entirely. The piston head is cut at its lower extremity, preferably by beveling or grooving, to have an oblique piston head so that at the peak of its course it can let the molten metal fill up the cylinder.

Figure 2:
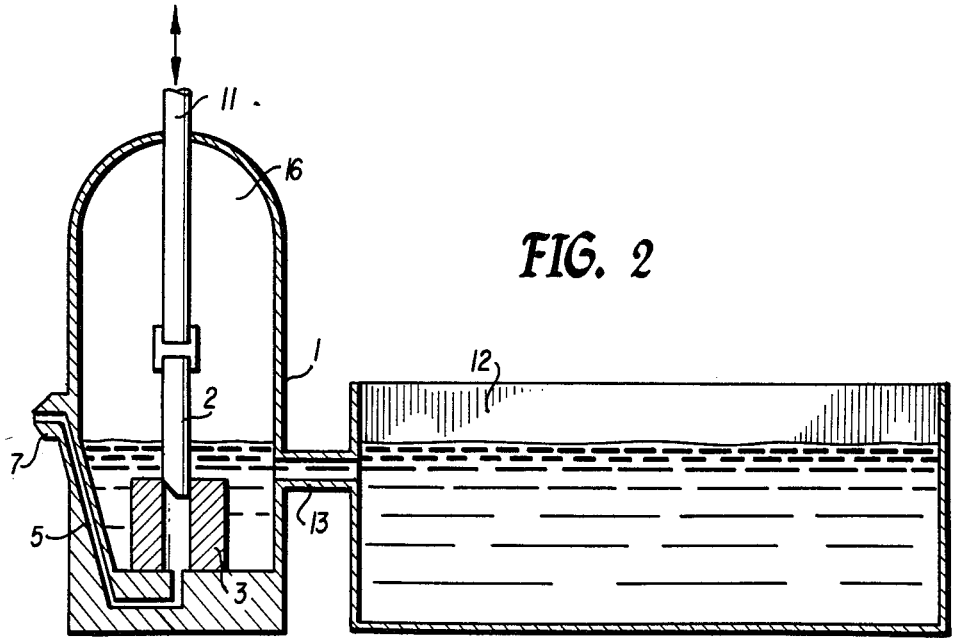
FIG. 2 is a schematic cross-section illustrating another embodiment of the claimed invention.

Depending on the manufacturing method chosen, the crucible 1 can be linked to a melting pot 12 by a channel 13 as in FIG. 2 or be within a melting pot as in FIG. 1. The preferred type of channel is the submerged sort which prevents air or oxide passing from the melting pot to the pump unit.

In order to prevent oxide from forming on the surface of the bath, consists of protecting the bath may be protected from any contact with air by a neutral atmosphere 16 such as Ar or $N_2$, or any other non-oxidizing gas or mixture of non-oxidizing gases (as in FIG. 2). In FIG. 2, the melting pot is separated from the pump unit but non-oxidizing atmospheres can be used also where the pump unit is enclosed within the melting pot.

The gooseneck 5 can be formed of only rectilinear parts so that tubes may be inserted.

The loosening (free play) due to the thermal expansion differences which appear between the inserted pieces and the surrounding structure may be compensated for by a system of bevel-edged rings.

The vessel 1 is made of cast iron, preferably very resistant to aluminum corrosion, e.g. aluminum cast iron (I. B. Serelryakova et al, Protection of Metals 3 (1) 1967 95) or chrome cast iron (H Fr Honsel et al, Aluminum 39 (1963) 675).

The piston 2 and cylinder 3 are made of $Si_3N_4$ or from a composition of Si-Al-O-N called Sialones, hot-pressed, very hard materials perfectly resistant to molten aluminum and oxidation, unwetted by molten aluminum and resistant to abrasion and erosion.

The cylinder-end 4 and the gooseneck 5 can be protected by an ALN, chromized or sulphurized coating or by the tube inserts made of alumina, beryllia or other pure or mixed oxides such as aluminum titanate, stumatite (natural alumino-silicate), of Sialones, of AlN, of sintered $Si_3N_4$, of chromium, in metallic form or bound in a cermet ($TiB_2$-Cr), borides of titanium, zirconium, chromium, tantalum, molybdenum and tungsten; carbides of silicon, titanium, zirconium, tantalum, vanadium, chromium, tungsten, molybdenum; and of other fairly hard materials which resist molten Al corrosion and erosion and which are hardly or not at all wetted by the latter.

The seals 6 applied by an appropriate technique can be made of BN or graphite or Cr. Elsewhere, the gooseneck can be protected by an AlN coating, by chrome or sulphur. The cylinder support 8 can also be made with one of the substances stated above which resist corrosion and possess sufficient mechanical properties.

The outlet nozzle 7 is made of hot-pressed $Si_3N_4$, hot pressed Sialones or lined with pieces of these materials. Due to the non-wetting properties of these materials with molten aluminum, the danger of the formation of a solid lump of alloy after each injection is greatly reduced.

The crucible 1 is protected from corrosion and oxidation by a coating 9 of Cr, $Al_2O_3$ or other oxides such as $Al_2O_3$-$TiO_2$, of $TiB_2$, $ZrB_2$, $CrB_2$ or other pure or mixed borides, AlN, $Si_3N_4$, BN, Sialones or other nitrides, applied in an appropriate way, such as slurry, flame spraying or covering by plates even if they are not placed in an impermeable way (the sealing off is caused by the formation of compounds like Fe-Al or Fe-Al-Si CH 588 320).

The apertures necessary to enter the gooseneck and to machine other parts of the pump may be closed by conical plugs 10 held in place by screws. The plugs are made of materials which resist corrosion and erosion such as $Si_3N_4$, AlN, SI-Al-O-N, BN, CR metal, $TiB_2$, $ZrB_2$, $Al_2O_3$, BeO, aluminum titanate, stumatite, graphite or others.

Other parts of the machine, i.e. the dies, particularly those made of cast iron and die steel are subject to corrosion by the molten metal, although to a lesser degree because of the lower temperature than that of the pump. The dies are above all subject to oxidation, to a certain erosion by the molten metal, to thermal shock during casting, to a degradation as some pieces weld to the die and to the thermal cycles during cooling of the castings and to mechanical shocks during withdrawal from the die.

The present invention also concerns the covering of dies with materials which are neither corroded nor wetted by the metals to be cast, which improve the surface of the cast pieces, which facilitate their withdrawal from the die and which increase the die's lifetime. To this effect, dies of cast-iron or steel, or other materials, are lined or coated with a dense, adherent layer, of good surface condition and thick enough to guarantee long lifetime, composed of $Si_3N_4$, AlN, Si-Al-O-N, BN, graphite or pyrolitic carbon, pure or alloyed.

I claim:

1. A hot chamber die casting apparatus, to be used in the casting of articles of aluminum, aluminum alloys, zinc, magnesium, copper and their alloys and all other alloys which in the molten state corrode ferrous materials, comprising, a crucible for molten metal;

an injection cylinder and piston assembly disposed in said crucible, said cylinder having an inlet end and a discharge end, the top of the head of said piston being so shaped as to be partly withdrawn from the inlet end of said cylinder during each piston cycle to periodically open said cylinder to said crucible;

a gooseneck having an inlet end and discharge end, the inlet end of said gooseneck being connected to the discharge end of said cylinder, and an outlet nozzle connected to the discharge end of said gooseneck and opening externally of said crucible to a die, the apparatus being characterized by the fact that said cylinder and said piston are made of at least one of the group consisting of hot-pressed, very hard silicon nitrides or sialones of high density.

2. An apparatus according to claim 1 characterized by the fact that the crucible acts as a melting pot for the molten metal.

3. An apparatus according to claim 1 characterized by the fact that the crucible receives molten metal from a melting pot through a channel, said channel being located below the molten metal level of the melting pot to prevent the passage of air or metallic oxide from the melting pot to the crucible.

4. An apparatus according to claim 1 characterized by the fact that the surface of the molten metal in the crucible is protected from air oxidation by a non-oxidizing atmosphere.

5. An apparatus according to claim 1 characterized by the fact that the discharge end of said cylinder is fixed to the bottom of the vessel.

6. An apparatus according to claim 1 characterized by the fact that the piston is guided in its reciprocating motion by a piston holder.

7. An apparatus according to claim 1 is characterized by the fact that the head of said piston is beveled.

8. An apparatus according to claim 1 which includes a cylinder-end of a hard material of high density, resistant to corrosion and erosion, said material being drawn from at least one of the group consisting of metallic chrome, silicon nitride, aluminum nitride, sialones, borides of titanium, of zirconium, of chromium, of tantalum, of molybdenum, of tungsten, carbides of silicon, of titanium, of zirconium, of tantalum, of vanadium, of chromium, of tungsten, of molybdenum, aluminum and beryllium oxides, and aluminum titanate.

9. An apparatus according to claim 1 which includes a cylinder support fixing said cylinder to said crucible, said support being made of a material which resists corrosion and which possesses sufficient mechanical properties, said material being drawn from at least one of the group consisting of metallic chrome, silicon nitride, aluminum nitride, zirconium titanate, sialones, borides of titanium, of zirconium, of chromium, of tantalum, or molybdenum, of tungsten, carbides of silicon, of titanium, of zirconium, of tantalum, of vanadium, of chromium, of tungsten, of molybdenum, aluminum and beryllium oxides, and aluminum titanate, as well as stumatite or graphite.

10. An apparatus according to claim 1 characterized by the fact that the gooseneck are protected by coatings or linings made of a material which resists corrosion and erosion, said material being drawn from at least one of the group consisting of metallic chrome, silicon nitride, aluminum nitride, zirconium titanate, sialones, borides of titanium, of zirconium, of chromium, of tantalum, of molybdenum, of tungsten, carbides of silicon, of titanium, of zirconium, of tantalum, of vanadium, of chromium, of tungsten, of molybdenum, aluminum and beryllium oxides, stumatite, and aluminum titanate.

11. An apparatus according to claim 1 characterized by the fact that the outlet nozzle is made of or lined with at least one of the materials selected from the group consisting of hot-pressed, very hard silicon nitride and Sialones of high density.

12. An apparatus according to claim 1 which includes seals between its various elements made of a material resistant to corrosion and erosion, said material being drawn from at least one of the group consisting of metallic chrome, silicon nitride, aluminum nitride, zirconium titanate, sialones, borides of titanium, of zirconium, of chromium, of tantalum, of molybdenum, of tungsten, carbides of silicon, of titanium, of zirconium, of tantalum, of vanadium, of chromium, of tungsten, of molybdenum, aluminum and beryllium oxides, and aluminum titanate as well as boron nitride, graphite and stumatite.

13. An apparatus according to claim 3 characterized by the fact that the crucible and melting pot are protected from corrosion and oxidation by an adhesive coating of, at least one of the group consisting of metallic chrome, silicon nitride, aluminum nitride, zirconium titanate, sialones, borides of titanium, of zirconium, of chromium, of tantalum, of molybdenum, of tungsten, carbides of silicon, of titanium, of zirconium, of tantalum, of vanadium, of chromium, of tungsten, of molybdenum, aluminum and beryllium oxides, and aluminum titanate.

14. An apparatus according to claim 1 characterized by the fact that the die is protected from erosion, adherence of the cast parts and corrosion, by coatings of at least one of $Si_3N_4$, AlN, Si-Al-O-N, BN, and carbon.

15. An apparatus according to claim 1 characterized by the fact that the head of said piston is grooved.

* * * * *

UNITED STATES PATENT AND TRADEMARK OFFICE

CERTIFICATE OF CORRECTION

PATENT NO. : 4,556,098

DATED : December 3, 1985

INVENTOR(S) : Hintermann et al

It is certified that error appears in the above-identified patent and that said Letters Patent is hereby corrected as shown below:

ON THE SUMMARY PAGE:

At item [75], please change "BERN" to —INS—.

At item [73], after "Horlogeres" insert —,Neuchatel and Injecta Limited, Teufenthal—.

At Item [56], line 5 for U.S. Patent No. 3,319,702, change "Hortwig" to —Hartwig—;

line 10 for U.S. Reference No. 74623/74 change "France" to —Japan—.

Under [56], OTHER PUBLICATIONS, please delete lines 2-8, and insert

—"Possibilities with Aluminium Pressue - diecastings" by Dr. A.C. Street, Foundry Trade Journal, May 31, 1973, pp. 699-701 and 703.

"Production of Hot Chamber Aluminium Die Castings Using a Pump for Handling Molten Metal" by P.W. Marshall, Foundry Trade Journal, November 26, 1970, pp. 797-805.

"Betriebliche Untersuchungen zum Vergiessen von Aluminium mit Warmkammer-Druckgiessmaschinen" by P. William Marshall, Giesserei Band 58, 1971, Nr. 10, pp. 300-306.

"Ueber den Angriff flussiger Leichtmetalle auf Eisenlegierungen und deren Verwendung als Tiegelwerkstoff in Giessereibetrieben" by H-Fr. Honsel, H Borchers and H.A. Nipper, Aluminium Band 39, 1963, Nr. 11, pp. 675-682.—

UNITED STATES PATENT AND TRADEMARK OFFICE

CERTIFICATE OF CORRECTION

PATENT NO. : 4,556,098

DATED : December 3, 1985

INVENTOR(S) : Hintermann et al

It is certified that error appears in the above-identified patent and that said Letters Patent is hereby corrected as shown below:

IN TABLE I AT COLUMN 4 OF THE SPECIFICATION:

Change the fourth column heading from "Thermal Expansion Coef 0-750° C. $10^6$ $C^{-1}$" to —Thermal Expansion Coef 0-750° C. $10^{-6}$ $C^{-1}$—;
In column 1, under Material, row 2 for Cast Iron, change "Cast Iron" to —Cast Iron (Al)—;
In column 5 under Resistance to Oxidation, row 7 for BN, insert —average—;
In column 6, under Resistance to Thermal Shock, row 7 for BN, delete "average";
In column 3, under Hardness, row 10 for BeO, change "2000 HV" to —2000 HV**—;
In column 3 under Hardness, row 15 for $ZrB_2$, change "2000 HV" to —2200 HV**—;
In column 3, under Hardness, row 16 for $CrB_2$ change "1800 HV" to —1800 HV**—;
In column 3 under Hardness, row 17 for TiC, change "3000 HV" to —3000 HV**—;
In column 3 under Hardness, row 18 for TiN, change "2000 HV" to —2000 HV**—;
In column 3 under Hardness, row 19 for SiC change "3000 HV" to —3000 HV**—;
Below row 19 for SiC, change "Remaks: attacked by Al-Si" to —Remarks: attacked by Ar-Si **Approximate value—.

UNITED STATES PATENT AND TRADEMARK OFFICE

CERTIFICATE OF CORRECTION

PATENT NO. : 4,556,098

DATED : December 3, 1985

INVENTOR(S) : Hintermann et al

It is certified that error appears in the above-identified patent and that said Letters Patent is hereby corrected as shown below:

IN THE SPECIFICATION:

Column 1, line 57, change "Peformance" to —Performance—.
Column 2, line 18, change "die pump" to —die casting pump—;
line 19, change "depite" to —despite—;
line 35, change "$TrB_2$" to —$ZrB_2$—;
line 38, after "run," insert —result in unallowed—.
Column 5, line 31, after "bath" delete —consists of protecting—.
line 55, change "ALN" to —AlN—.
Column 6, line 18, after "Fe-Al-Si" insert —as shown in the Swiss Patent—.

IN THE CLAIMS:

Claim 10, line 2, change "are" to —is—.

Signed and Sealed this

*Tenth* Day of *June 1986*

[SEAL]

*Attest:*

DONALD J. QUIGG

*Attesting Officer*

*Commissioner of Patents and Trademarks*